US007775080B2

(12) United States Patent
Ogawa et al.

(10) Patent No.: US 7,775,080 B2
(45) Date of Patent: Aug. 17, 2010

(54) ROLLING METHOD AND ROLLING APPARATUS FOR FLAT-ROLLED METAL MATERIALS

(75) Inventors: Shigeru Ogawa, Futtu (JP); Kenji Yamada, Futtu (JP); Toshiyuki Shiraishi, Futtu (JP); Yasuhiro Higashida, Futtu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/319,021

(22) Filed: Dec. 30, 2008

(65) Prior Publication Data

US 2009/0178457 A1 Jul. 16, 2009

Related U.S. Application Data

(62) Division of application No. 10/550,079, filed as application No. PCT/JP2004/003341 on Mar. 12, 2004, now Pat. No. 7,481,090.

(30) Foreign Application Priority Data

Mar. 20, 2003 (JP) ..... 2003-076970

(51) Int. Cl.
*B21B 23/00* (2006.01)
*B21B 29/00* (2006.01)

(52) U.S. Cl. ..... 72/366.2; 72/242.2

(58) Field of Classification Search ..... 72/8.1, 72/8.3, 8.4, 8.7, 8.9, 9.1, 10.4, 11.1, 11.7, 72/14.4, 18.7, 241.4, 241.6, 241.8, 242.4, 72/242.6, 242.8, 243.2, 243.4, 243.6, 366.2, 72/365.2

See application file for complete search history.

(56) References Cited

U.S. PATENT DOCUMENTS

| | | | |
|---|---|---|---|
| 1,614,425 | A | 1/1927 | Coe |
| 2,792,730 | A | 5/1957 | Cozzo |
| 3,429,166 | A | 2/1969 | Baker et al. |
| 3,587,263 | A | 6/1971 | McCarthy |
| 4,320,643 | A | 3/1982 | Yasuda et al. |
| 5,609,054 | A | 3/1997 | Ogawa et al. |
| 2006/0230799 | A1 | 10/2006 | Ogawa et al. |

FOREIGN PATENT DOCUMENTS

| | | |
|---|---|---|
| DE | 3537153 | 5/1987 |

(Continued)

OTHER PUBLICATIONS

Shiroo Suzuki, et al., "Strip shape control system of Mitsubishi CR Mill", Industry Applications Conference, Phoenix, AZ, USA, Oct. 3, 1999, vol. 1, pp. 564-570.

*Primary Examiner*—Dana Ross
*Assistant Examiner*—Teresa M Bonk
(74) *Attorney, Agent, or Firm*—Kenyon & Kenyon LLP

(57) ABSTRACT

A rolling method and a rolling apparatus for flat-rolled metal materials that stably produces flat-rolled metal materials having no or extremely little camber. The rolling mill having work rolls with split backup rolls supporting at least one work roll is provided with at least one pair of pinch rolls for clamping the rolled material on the exit side of the rolling mill. The difference between the rolling direction force acting on the work rolls at the right and left sides is calculated. The left-right difference of the roll gap of the work rolls is controlled as a result of the calculated difference.

2 Claims, 4 Drawing Sheets

FOREIGN PATENT DOCUMENTS

| | | |
|---|---|---|
| JP | 04-305304 | 10/1992 |
| JP | 06 262 207 A | 9/1994 |
| JP | 07-214131 | 8/1995 |
| JP | 08-323411 | 12/1996 |
| JP | 2000-158026 | 6/2000 |
| JP | 2001-105013 | 4/2001 |
| JP | 2002-346615 | 12/2002 |
| WO | WO 01/91934 | 12/2001 |

ROLLING METHOD AND ROLLING APPARATUS FOR FLAT-ROLLED METAL MATERIALS

This application is a divisional patent application under 35 U.S.C. §120 and §121 of prior application Ser. No. 10/550,079 filed Sep. 19, 2005, now U.S. Pat. No. 7,481,090, which is a 35 U.S.C. §371 of International Application No. PCT/JP2004/003341 filed Mar. 12, 2004, wherein PCT/JP2004/003341 was filed and published in the Japanese language.

This invention relates to a rolling method and a rolling apparatus for flat-rolled metal materials. More particularly, the invention relates to a rolling method and a rolling apparatus, for flat-rolled metal materials that can stably produce flat-rolled metal materials not having, or having extremely little, camber.

TECHNICAL FIELD

In a rolling process for a flat-rolled metal material, it is very important to roll a sheet material to be rolled in a form free from camber, or in the form not having bend in the left-right direction, in order to avoid not only a plane shape defect and a dimensional accuracy defect of the rolled material but also to avoid sheet pass troubles such as a zigzag movement and a tail crash. Incidentally, to simplify the description, the operator side and the driving side of the rolling mill, as the right and left sides when the rolling mill is seen from the Front of the rolling direction, will be called "right and left", respectively.

To cope with such problems, Japanese Unexamined Patent Publication (Kokai) No. 4-305304 discloses a camber control technology that arranges devices for measuring the lateral positions of the rolled material on the entry and exit sides of the rolling mill, calculates the camber of the rolled material from the measurement values and regulates the position of an edger roll arrange on the entry side of the rolling mill to correct the camber.

On the other hand, Japanese Unexamined Patent Publication (Kokai) No. 7-214131 discloses a camber control technology that controls a left-right difference of roll gap of the roiling mill, that is, reduction leveling, on the basis of a left-right difference in edger roll loads provided on the entry and exit sides of the rolling mill.

Japanese Unexamined Patent Publication (Kokai) No. 2001-105013 discloses a camber control technology that analyzes actual measurement values of a left-right difference of rolling loads and controls a left-right difference of roll gap, that is, reduction leveling, or positions of side guides.

Japanese Unexamined Patent Publication (Kokai) No. 8-323411 discloses a method that conducts camber control by restricting a rolled material by an edger roll and a side guide on the entry side and a side guide on the exit side.

However, the invention relating to the camber control technology by the lateral position measurement of the rolled material described in Japanese Unexamined Patent Publication (Kokai) No. 4-305304 is basically directed to the correction of a camber that has already occurred and cannot substantially prevent, in advance, the occurrence of the camber.

According to the invention relating to the camber control technology based on the edger roll load left-right difference on the entry and exit sides of the rolling mill and described in Japanese Unexamined Patent Publication (Kokai) No. 4-305304, it is difficult to acquire high control accuracy when the camber already exists in the rolled material on the entry side because the camber operates as disturbance to the edger roll load difference on the entry side. The edger roll on the exit side must be saved back at the time of passing of the distal end of the rolled material in order to avoid impingement, and it is difficult, too, to conduct camber control from the distal end of the rolled material.

According to the invention relating to the camber control technology based on the rolling load left-right difference described in Japanese Unexamined Patent Publication (Kokai) No. 2001-105013, the method of estimating the camber from the left-right difference of the rolling load has extremely low accuracy and is not practical when the sheet thickness of the rolled material on the entry side is not uniform in the width direction or when the temperature distribution of the rolled material is not uniform in the width direction.

In the invention relating to the camber control by using the edger roll on the entry side, the side guide on the entry side and the side guide on the exit side as described in Japanese Unexamined Patent Publication (Kokai) No. 8-323411, the exit side camber can be made zero if the side guide on the exit side can completely restrict the rolled material on the exit side. However, because the side guide on the exit side must be kept greater than the sheet width of the rolled material in order to smoothly carry out the rolling operation, the camber occurs on the rolled material to an extent corresponding to this margin.

After all, it can be concluded that the problems of the prior art technologies described above result from the absence of a method that can measure and control highly accurately and without time delay a camber that occurs owing to various causes.

DISCLOSURE OF THE INVENTION

It is therefore an object of the invention to provide a rolling method for a flat-rolled metal material, and a rolling apparatus using the method, that can advantageously solve the problems, in the prior art technologies, of the camber control described above and can stably produce a flat-rolled metal material not having, or having extremely little, camber.

The gist of the invention for solving the problems of the prior art technologies is as follows.

(1) A rolling method for a flat-rolled metal material, for executing rolling by using rolling equipment including a rolling mill and at least a pair of pinch rolls for clamping a rolled material on the exit side of the rolling mill having a construction in which either one, or both, of upper and lower roll assemblies have a mechanism for supporting a work roll by split backup rolls split into at least three segments in an axial direction, the split backup roll group having a construction for supporting both a vertical direction load and a rolling direction load acting on the contacting work roll and each of the split backup rolls independently having a load measuring device, the method comprising the steps of directly measuring, or calculating on the basis of a predetermined measurement value, either one, or both, of left-right balance of rolling direction force acting on the rolled material from the pinch rolls and left-right balance of rolling direction force acting on the work roll of the rolling mill through the rolled material; and controlling a left-right swivelling component of roll gap of the rolling mill on the basis of the measured value or the calculated value of the left-right balance of the rolling direction force.

(2) A rolling method for a flat-rolled metal material as described in (1) given above, wherein the pinch roll on the exit side of the rolling mill includes a pinch roll rotation driving device capable of applying a rolling traveling direction force to the rolled material so that a pinch roll torque generated from the driving device is controlled and tension is applied to the rolled material.

(3) A rolling method for a flat-rolled metal material, for executing rolling by using rolling equipment including a rolling mill and a coiling device for coiling a rolled material on the exit side of the rolling mill having a mechanism in which either one, or both, of upper and lower roll assemblies support a work roll by split backup rolls split into at least three segments in an axial direction, the split backup roll group having a construction for supporting both a vertical direction load and a rolling direction load acting on the contacting work roll, each of the split backup rolls independently having a load measuring device, the method comprising the steps of calculating a left-right balance of rolling direction force, acting on the work roll of the rolling mill through the rolled material, on the basis of a measured value of the split backup roll load of the rolling mill; and controlling a left-right swivelling component of roll gap of the rolling mill.

(4) A rolling apparatus for a flat-rolled metal material comprising a rolling mill having a construction in which either one, or both, of upper and lower roll assemblies have a mechanism for supporting a work roll by split backup rolls split into at least three segments in an axial direction, the split backup roll group having a construction for supporting both a vertical direction load and a rolling direction load acting on the contacting work roll, each of the split backup rolls independently having a load measuring device; a pair of pinch rolls arranged on the exit side of the rolling mill, for clamping the rolled material; a calculation device for calculating a left-right balance of a rolling direction force acting on the work roll contacting the split backup roll on the basis of a measured value of the split backup roll load of the rolling mill; a calculation device for calculating a control quantity of a left-right swivelling component of roll gap of the rolling mill on the basis of the calculated value of the left-right balance of the rolling direction force; and a control device for controlling the roll gap of the rolling mill on the basis of the calculated value of the left-right swivelling component control quantity of the roll gap.

(5) A rolling apparatus for a flat-rolled metal material comprising a rolling mill having a construction in which either one, or both, of upper and lower roll assemblies have a mechanism for supporting a work roll by split backup rolls split into at least three segments in an axial direction, the split backup roll group having a construction for supporting both a vertical direction load and a rolling direction load acting on the contacting work roll, each of the split backup rolls independently having a load measuring device; at least one pair of pinch rolls arranged on the exit side of the rolling mill, clamping the rolled material and having means for independently measuring a reaction of a rolling direction force acting between the pinch rolls and the rolled material on the work side and on the driving side; a calculation device for calculating a left-right balance of a rolling direction force acting between the rolled material and the pinch rolls from a measured value of the rolling direction reactions a calculation device for calculating a control quantity of a left-right swivelling component of roll gap of the rolling mill on the basis of the calculated value of the left-right balance of the rolling direction force; and a control device for controlling the roll gap of the rolling mill on the basis of the calculated value of the left-right swivelling component control quantity of the roll gap.

(6) A rolling apparatus for a flat-rolled metal material comprising a rolling mill having a construction in which either one, or both, of upper and lower roll assemblies have a mechanism for supporting a work roll by split backup rolls split into at least three segments in an axial direction, the split backup roll group having a construction for supporting both vertical direction load and rolling direction load acting on the contacting work roll, each of the split backup rolls independently having a load measuring device; a coiling device for coiling the rolled material, arranged on the exit side of the rolling mill; a calculation device for calculating a left-right balance of a rolling direction force acting on the work roll contacting the split backup rolls on the basis of the measured value of the split backup roll load of the rolling mill; a calculation device for calculating a control quantity of a left-right swivelling component of roll gap of the rolling mill on the basis of the calculated value of the left-right balance of the rolling direction force; and a control device for controlling the roll gap of the rolling mill on the basis of the calculated value of the left-right swivelling component control quantity of the roll gap.

BRIEF DESCRIPTION OF THE DRAWINGS

FIG. 5(*b*) is a view schematically showing a preferred form of a rolling apparatus for a rolling method according to the invention described in any of (1) to (3) or a rolling apparatus of the invention described in (4) to (6) and particularly explains a form of split backup rolls.

FIG. 5(*c*) is an A-A sectional view of FIG. 5(*a*).

BEST MODE FOR CARRYING OUT THE INVENTION

Figure 1:
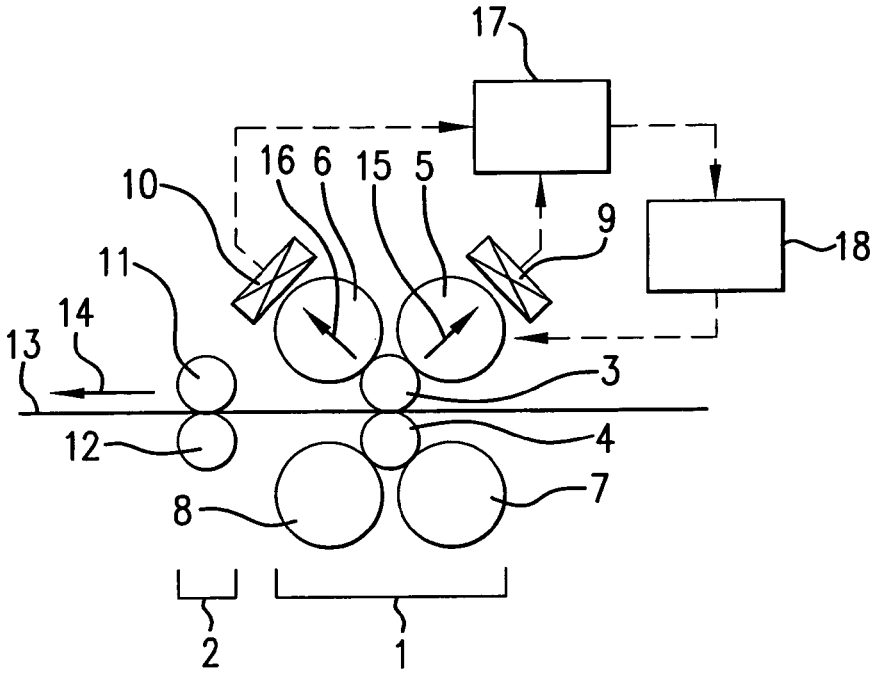
FIG. 1 is a view schematically showing a preferred form of a rolling apparatus for a rolling method according to the invention described in (1) or a rolling apparatus of the invention described in (4).

A mode for carrying out the invention will be hereinafter explained.

Generally, the causes of the occurrence of camber in rolling of flat-rolled materials are a setting defect of a roll gap, a left-right difference of the thickness of the rolled material on the entry side and a left-right difference of deformation resistance. Whichever the cause may be, the left-right difference occurs eventually in an exit side speed of the rolled material to cause camber because a left-right difference occurs in the longitudinal strain in a rolling direction that results from rolling.

According to the rolling method of the flat-rolled metal material of the invention described in (1), the pinch rolls on the exit side of the rolling mill clamp the rolled material and always rotate at a constant roll peripheral speed in the widthwise direction. Therefore, when the left-right difference of the rolled material on the exit side that directly results in the camber occurs, a mismatch occurs in the sheet widthwise direction between the peripheral speed of the pinch rolls and the speed of the rolled material on the exit side, so that the left-right difference occurs in the rolling direction (horizontal direction) force acting between the pinch rolls and the rolled material. In other words, the side of the rolled material on the exit side that has a low speed is relatively pulled by the pinch rolls and the side having a high speed relatively receives the push-back force by the pinch rolls. The left-right unbalance of the rolling direction force manifests itself as the left-right difference of the rolling direction reaction acting on the pinch rolls and the left-right difference of the rolling direction force acting on the work roll of the rolling mill through the rolled material. When either one of them is detected and measured, it becomes possible to immediately detect the left-right difference of the longitudinal strain directly resulting in the camber and the left-right difference of the speed of the rolled material on the exit side at the point of occurrence. It becomes possible to prevent, in advance, the occurrence of the camber by controlling the roll gap in the direction that eliminates the left-right difference to the rolled material speed on the exit side so detected, that is, by reducing the roll gap on the side at which the rolled material speed on the exit side is low and increasing the roll gap on the high speed side.

As explained above, the method of the invention described in (1) detects and measures the left-right difference of the rolled material speed on the exit side that directly results in the occurrence of the camber and executes the roll gap operation for immediately making uniform the difference. Therefore, rolling substantially free from, or with extremely little, camber can be accomplished.

Besides the construction described in (1), in the invention described in (2), each pinch roll on the rolling mill exit side has a pinch roll rotation driving device capable of applying the rolling traveling direction force to the rolled material, and the pinch roll torque occurring from this driving device is so controlled as to let tension operate on the rolled material. According to this rolling method, rolling is carried out while the tension is allowed to act on the rolled material from the pinch rolls. Therefore, rolling free from camber can be executed while the shape of the rolled material is kept excellent. Because the rolling direction force acting between the pinch rolls and the rolled material becomes unidirectional, the apparatus construction for measuring the rolling direction force from the pinch roll side can be simplified.

The invention described in (3) is a rolling method that is particularly suitable for a thin sheet product because it takes up the thin sheet into a coil shape. In other words, even though the pinch rolls do not exist on the exit side of the rolling mill, the left-right difference of the tension of the rolled material occurs between the coiling device and the rolling mill when the left-right difference of the longitudinal strain is the cause of the occurrence of the camber, and this manifests itself as the left-right unbalance of the rolling direction force acting on the work roll of the rolling mill. When this left-right difference of the rolling direction force is extracted and calculated from the measured value of the split backup roll load of the rolling mill, this calculation force directly reflects the left-right difference of the speed of the rolled material on the exit side of the rolling mill as the cause of the occurrence of the camber. Therefore, the camber can be prevented by controlling the left-right swivelling component of the roll gap of the rolling mill on the basis of the calculated value.

Next, the invention relating to the rolling mill for executing the rolling methods of the flat-rolled metal materials described in (1) through (3) will be explained.

In the invention described in (4), the split backup rolls of the rolling mill do not exist immediately above or immediately below the work roll for the purpose of supporting both a vertical direction load and a rolling direction (horizontal direction) load acting on the work roll but are split into an exit side backup roll group contacting the work roll with an inclination with respect to the vertical direction and an entry side-backup roll group or in other words, into a so-called "cluster structure". A load measuring device provided to such a backup roll measures each split backup roll load measurement value and the resultant force acting on the work roll is calculated by extracting the horizontal direction or rolling direction component on the basis of each split backup roll load measurement value. In this way, the left-right balance of the rolling direction force, that results from the left-right difference of the speed of the rolled material on the exit side, acts on the work roll and results in the occurrence of the camber, can be calculated. Because the rolling apparatus includes the calculation device, the calculation device for calculating the left-right swivelling component control quantity of the roll gap of the rolling mill on the basis of the calculated value of the left-right balance of the rolling direction force and the control device for controlling the roll gap of the rolling mill on the basis of the calculated value of the left-right swivelling component control quantity of the roll gap, it becomes possible to make uniform the speed of the rolled material on the exit side of the rolling mill that may result in the occurrence of the camber and to accomplish rolling free from the occurrence of camber.

In the invention described in (5), each pinch roll has the device for directly detecting and measuring the left-right difference of the rolling direction force acting between the rolled material and the pinch roll. Therefore, the invention can immediately detect the left-right difference of the speed of the rolled material on the exit side of the rolling mill that may result in the occurrence of camber, and can control the roll gap of the rolling mill to prevent camber.

The invention described in (6) provides the rolling apparatus for executing the rolling method of the invention described in (3) and has a coiling device on the exit side of the rolling mill. Therefore, when the left-right difference of the speed of the rolled material on the exit side of the rolling mill that may result in the occurrence of the camber occurs, the left-right difference occurs in the tension of the rolled material from the rolling mill to the coiling device and is transmitted as the rolling direction force to the work roll of the rolling mill. Because the rolling apparatus includes the calculation device for calculating the left-right balance of the rolling direction force acting on the work roll on the basis of the measured value of the split backup roll load, the calculation device for calculating the left-right swivelling component control quantity of the roll gap of the rolling mill on the basis of the calculation result of the former and the control device for controlling the roll gap of the rolling mill on the basis of the calculated value of the left-right swivelling component control quantity of the roll gap, the speed of the rolled material on the exit side of the rolling mill that may result in the occurrence of camber can be made uniform and rolling free from the occurrence of camber can be accomplished.

Next, the embodiment of the invention will be explained further concretely with reference to the drawings.

Figure 5A:
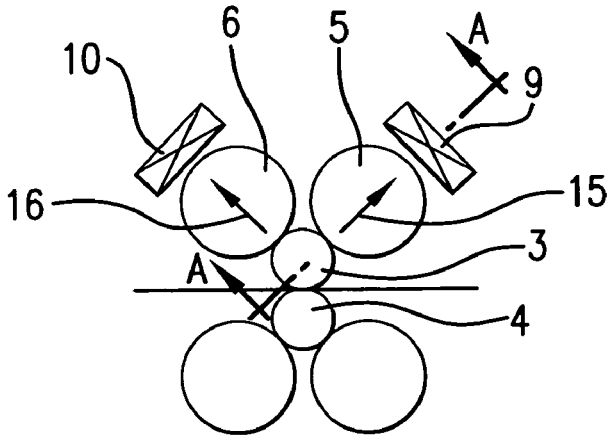
FIG. 5(*a*) is a view schematically showing a preferred form of a rolling apparatus for a rolling method according to the invention described in any of (1) to (3) or a rolling apparatus of the invention described in (4) to (6) and particularly explains a form of split backup rolls.
Figure 5B:
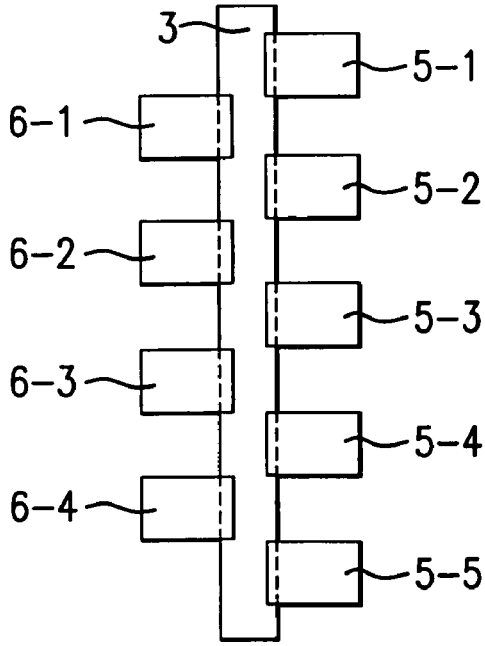
Figure 5C:
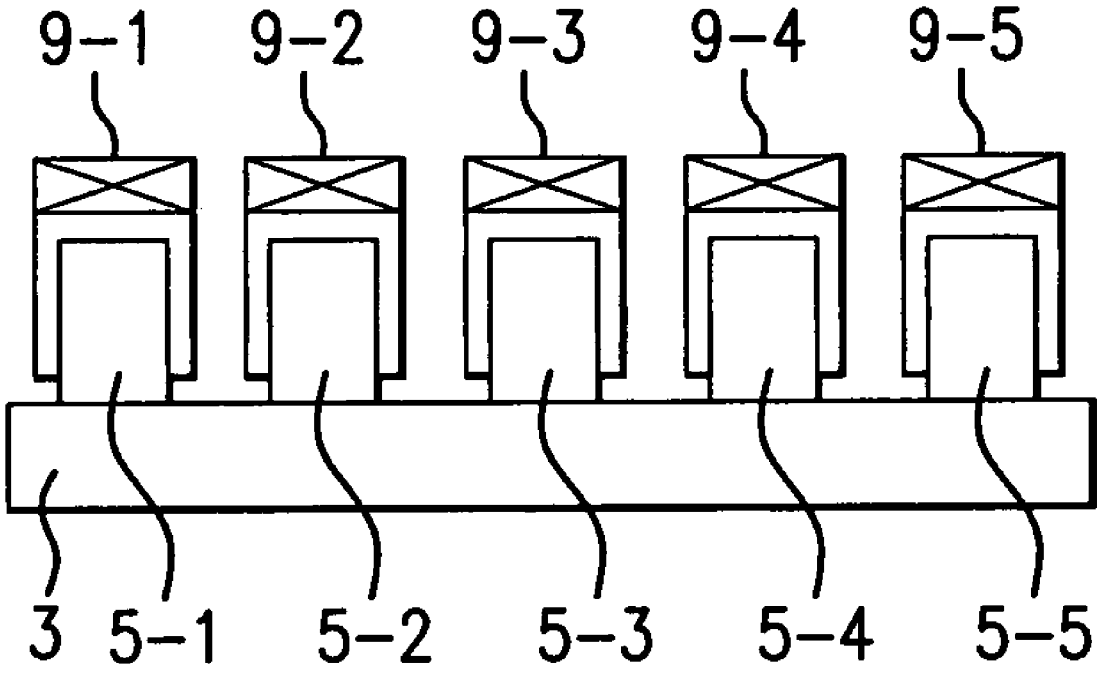

FIG. 1 shows the rolling apparatus relating to the rolling method described in (1) or the rolling apparatus described in (4) according to a preferred embodiment of the invention. A pinch roll 2 is disposed on the exit side of the rolling mill 1. The tolling mill 1 includes a plurality of split backup rolls 5, 6, 7 and 8 in an axial direction on the entry and exit sides as shown in FIGS. 5(*a*) to 5(*c*). Particularly, load measuring devices 9-1, 9-2, 9-3, 9-4 and 9-5 (refer to an A-A sectional view of FIG. 5(*c*)) and 10-1, 10-2, 10-3 and 10-4 (sectional view of which is omitted) are individually provided to the upper split backup rolls 5-1, 5-2, 5-3, 5-4 and 5-5, respectively, on the entry side and to the upper split backup rolls 6-1, 6-2, 6-3 and 6-4 on the exit side. Incidentally, a material to be rolled 13 is rolled in a rolling direction 14. The rolling mill 1 has split backup rolls on the entry and exit sides and each of which has the load measuring device. Therefore, when the horizontal direction component of the upper split backup roll load acting on the upper split backup roll load operation line directions 15 and 16 on both entry and exit sides, that is, the rolling direction-component, is calculated on the basis of the split backup roll load measured value, the left-right balance of the rolling direction force acting on the upper work roll 3 through the rolled material 13 can be calculated. This calculation device is denoted by reference numeral 17.

The following calculation is made in this calculation device 17.

The following formulas can be obtained from the equilibrium conditional formula of the rolling direction force and moment acting on the work roll:

$$F_R^W+F_R^D=\Sigma q_i \cos\theta_i-(F^W+F^D) \quad <1>$$

$$F_R^W-F_R^D=(2/a_W)\Sigma Z_i q_i \cos\theta_i-(F^W-F^D) \quad <2>$$

where $q_i$ is the measurement value of the ith split backup roll load; $\theta_i$ is an angle between each split backup roll load operation line direction and the horizontal line (entry side split backup roll has an acute angle and the exit side split backup roll has an obtuse angle); $Z_i$ is the barrel length center position of each split backup roll expressed by roll axial direction coordinates with a mill center being an origin; $a_W$ is a center distance between a operator side chock and a driving side chock; and $F_R^W$ and $F_R^D$ are imaginary rolling direction forces when the rolling direction forces acting between the rolled material and the work roll are evaluated at the work roll chock positions on the operator side and the driving side, respectively.

Here, $F^W$ and $F^D$ are the actual values of the horizontal direction roll bending force acting on the work rolls on both operator and driving sides and may be omitted when the horizontal roll bending force is not provided. When the formulas <1> and <2> are solved together, $F_R^W$ and $F_R^D$ can be directly calculated. Particularly because the left-right balance of the rolling direction force acting between the rolled material and the work roll is hereby dealt with, $F_R^{df}=F_R^W-F_R^D$, that is, the left-right difference of the imaginary rolling direction force given by <2>, is calculated.

Next, the calculation device 18 calculates the control quantity of the left-right swivelling component of roll gap of the rolling mill on the basis of the calculation result of the left-right balance of the rolling direction force and controls the left-right swivelling component of the roll gap of the rolling mill 1 by using the calculated value as a control instruction value. Besides the case where the left-right difference itself, of the rolling mill 1, is controlled as the control value, it is possible at this time to employ an embodiment in which a left-right difference is applied to the control instruction value of the rolling load to indirectly control the left-right swivelling component of the roll gap in the case of the rolling operation where the control object is to set the rolling load to a predetermined value as in skin pass rolling.

Incidentally, FIG. 1 shows an example of the embodiment, in which only the load acting on the upper backup roll is measured. However, in a preferred embodiment, the lower backup roll has the same construction as the upper backup roll and is provided with the load measuring device so that the left-right balance in the rolling direction acting on the upper and lower work rolls through the rolled material 13 is calculated and controlled.

Figure 2:
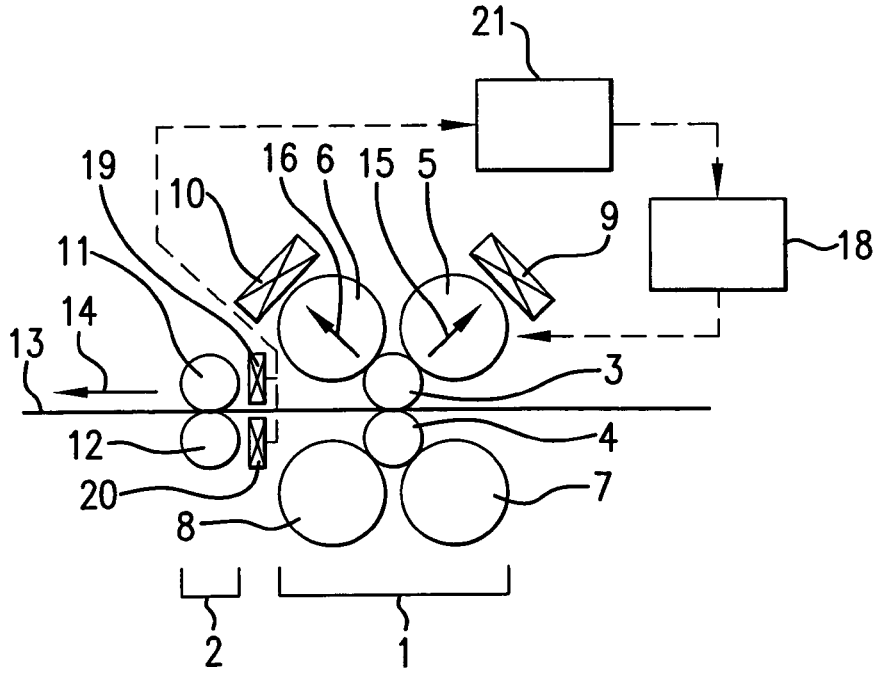
FIG. 2 is a view schematically showing a preferred form of a rolling apparatus according to the invention described in (2) in a rolling direction or a rolling apparatus of the invention described in (5).

FIG. 2 shows a rolling apparatus relating to a rolling method described in (2) or a rolling apparatus described in (5) according to a preferred embodiment of the invention. In the embodiment shown in FIG. 2, tension is allowed to act on the rolled material 13 by the pinch roll 2, and the exit side shape of the rolled material 13 can be further improved. The measuring devices 19 and 20 of the rolling direction force that act on the upper pinch roll 11 and the lower pinch roll 20, respectively, are so arranged as to be capable of measuring the rolling direction force acting on the pinch roll chocks on the operator side and the driving side, respectively. Therefore, they can detect and measure the left-right balance of the rolling direction force acting between the rolled material 13 and the pinch rolls 11 and 12. In other words, the calculation device 21 of the left-right balance of the rolling direction force acting on the pinch rolls calculates the left-right difference $F_p^{df}$ of the rolling direction force acting on the upper and lower pinch rolls in accordance with the following formula <3> from the rolling direction force $F_p^{TW}$ acting on the upper pinch roll chock on the operator side, the rolling direction force $F_p^{BW}$ acting on the lower pinch roll, the rolling direction force $F_p^{TD}$ acting on the upper pinch roll on the driving side and the rolling direction force $F_p^{BD}$ acting on the lower pinch roll:

$$F_p^{df}=(F_p^{TW}+F_p^{BW})-(F_p^{TD}+F_p^{BD}) \quad <(3>$$

This calculated value $F_p^{df}$ is a value representing the left-right balance of the rolling direction force acting between the rolled material and the pinch roll.

Next, the calculation device 18 calculates the left-right swivelling component control quantity of the roll gap of the rolling mill 1 on the basis of this calculated value. Here, the control quantity is calculated by PID calculation that takes a proportional (P) gain, an integration (I) gain and a differentiation (D) gain into consideration on the basis of $F_p^{df}$, for example. As the left-right swivelling component of the roll gap of the rolling mill 1 is controlled to this calculated value, rolling substantially free from the occurrence of camber can be accomplished.

The combined use of the rolling apparatuses explained respectively with reference to FIGS. 1 and 2 is a preferred embodiment with respect to the improvement of calculation accuracy of the left-right balance of the rolling direction force.

Figure 3:
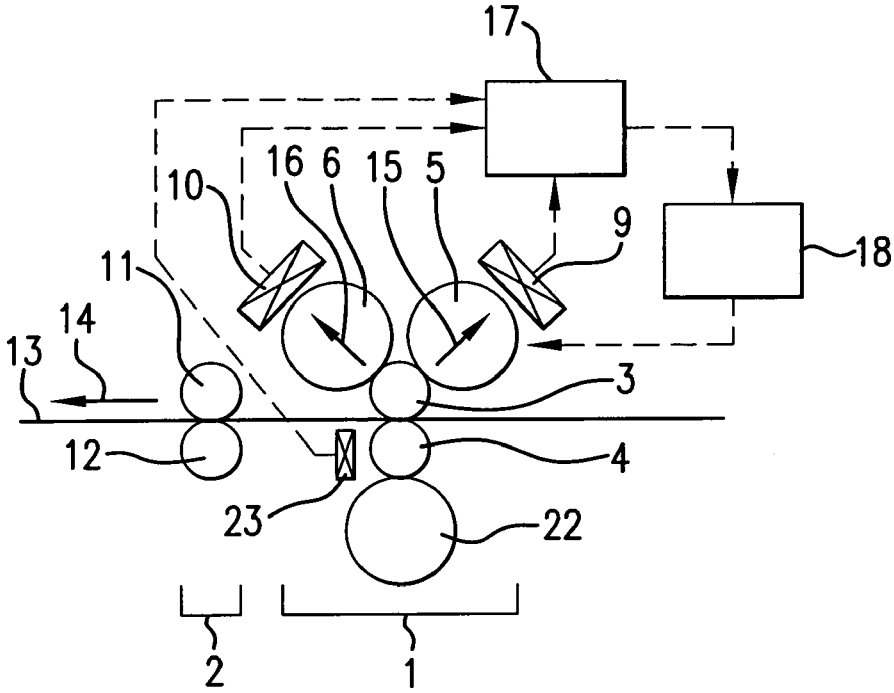
FIG. 3 is a view schematically showing a preferred form of a rolling apparatus for a rolling method according to the invention described in (1) or a rolling, apparatus of the invention described in (4).

FIG. 3 shows the rolling apparatus relating to the rolling method described in (1) or the rolling apparatus described in (4) according to another preferred embodiment of the invention. In this embodiment, the upper roll system of the rolling mill 1 is of the type shown in FIGS. 5(*a*) to. 5(*c*) but the lower roll system is the same as the type of the ordinary 4-stage rolling mill that includes the lower work roll 4 and the lower backup roll 22. However, measuring devices 23 capable of measuring the reaction of the rolling direction force acting on the roll chock are respectively provided to the lower work rolls 4 on the operator side and the driving side. The left-right balance of the rolling direction force acting on the lower work rolls can be calculated from the outputs of the measuring devices 23 in accordance with the same calculation algorithm as that of the calculation device 21 of the left-right balance of the rolling direction force acting on the pinch roll. As for the upper roll system, the left-right balance of the rolling direction force acting on the upper work roll can be calculated on the basis of the measured value of the split backup roll load in the same way as in the embodiment shown in FIG. 1. In this case, the calculation device 17 can calculate the left-right balance of the rolling direction force acting on the upper and lower work rolls of the rolling mill. The calculation device 18 for calculating the control quantity of the left-right swivelling component of the roll gap of the rolling mill calculates the left-right swivelling component of the roll gap of the rolling mill, on the basis of this calculation result, and excellent camber control can be obtained by controlling the left-right swivelling component of the roll gap of the rolling mill 1 on the basis of this calculated value.

Figure 4:
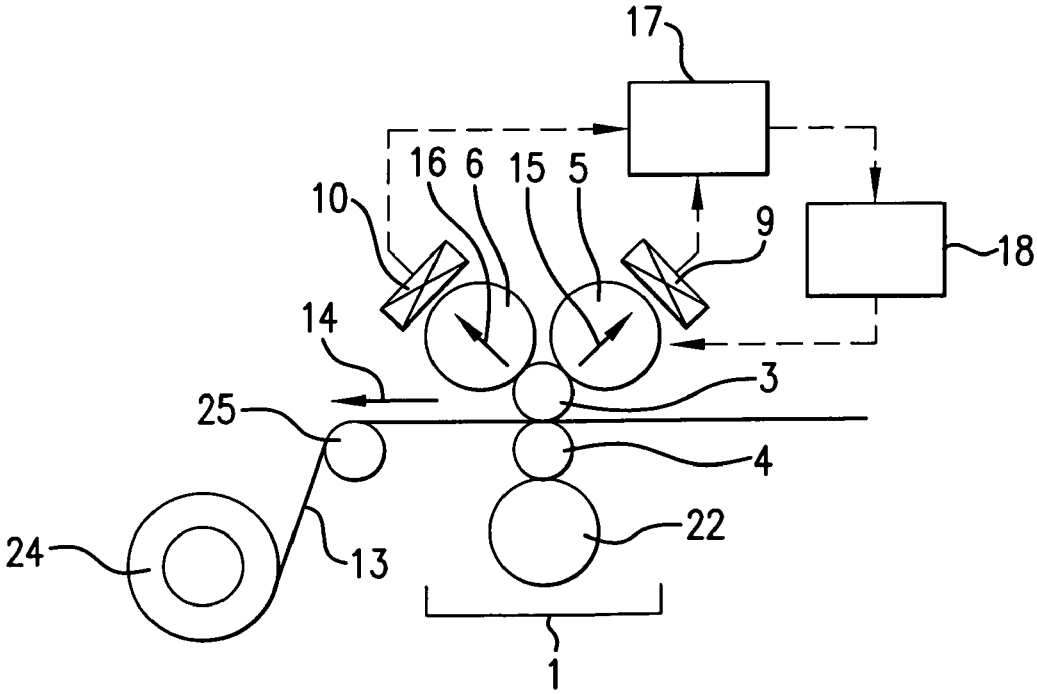
FIG. 4 is a view schematically showing a preferred form of a rolling apparatus for a rolling method according to the invention described in (3) or a rolling apparatus of the invention described in (6).

FIG. 4 shows the rolling apparatus relating to the rolling method described in (3) or the rolling apparatus described in (6) according to another preferred embodiment of the invention. This embodiment is directed to the rolling of thin sheets, and a deflector roll 25 and a coiling device 24 are arranged on the exit side of the rolling mill. In this case, too, the left-right difference of the rolling direction force acting between the rolling mill and the coiling device is transmitted to the work roll of the rolling mill in such a manner as to correspond to the left-right difference of the speed of the rolled material on the exit side of the rolling mill that may result in the occurrence of camber. Therefore, the left-right difference of the rolling direction force is calculated by the calculation device 17 from the measured value of the split backup roll load, and excellent camber control is executed by calculating and controlling the left-right swivelling component control quantity of the roll gap of the rolling mill to make uniform the speed of the rolled material on the exit side of the rolling mill.

Incidentally, there is also a preferred embodiment that combines, whenever necessary, the measurement/calculation device of the left-right balance of the rolling direction force of the lower work roll shown in FIG. 3 with the embodiment shown in FIG. 4, and further combines the measurement/calculation device of the left-right balance of the tension by disposing a tension measurement device on the operator side and driving side of the deflector roll to improve detection accuracy of the left-right balance of the tension between the rolling mill and the coiling device.

INDUSTRIAL APPLICABILITY

Flat-rolled metal materials not having, or having extremely little, camber can be stably produced, and the productivity and the yield of the rolling process of the flat-rolled metal materials can be drastically improved by using the rolling method and the rolling apparatus for a flat-rolled metal material according to the invention.

The invention claimed is:

1. A rolling method for a flat-rolled metal material, for executing rolling by using rolling equipment including a rolling mill (1) and at least a pair of pinch rolls (11, 12) for clamping a rolled material (13) on the exit side of said rolling mill having a construction in which either one, or both, of upper and lower roll assemblies have a mechanism for supporting a work roll (3, 4), by split backup rolls (5, 6) split into at least three segments in an axial direction, said split backup roll group having a construction for supporting both a vertical direction load and a rolling direction load acting on said contacting work roll and each of said split backup rolls independently having a load measuring device (9, 10), said method comprising the steps of:

calculating a difference $Fr^{df}$ between rolling direction force acting on said work rolls (3, 4) at a right side (operator side) of said work rolls and rolling direction force acting on said work rolls (3, 4) at a left side (driving side) of said work rolls through the rolled material using imaginary rolling direction force $F_R^W$ and $F_R^D$ acting between the rolled material and the work roll evaluated at the work roll chock position on the operator side and the driving side based on a measured value of backup roll load measured on each segment of said split backup roll by each independent load measuring device and the formula below:

$$F_R^W - F_R^D = (2/a_w)\Sigma Z_i q_i \cos\theta_i - (F^w - F^D),$$

controlling left-right difference of roll gap of said upper work roll and said lower work roll to result in said calculated difference $Fr^{df}$ of rolling direction force approaching zero;

where, $F_R^W$ and $F_R^D$ are imaginary rolling direction force when the rolling direction forces acting between the rolled material and the work roll are evaluated at the work roll chock positions on the operator side and the driving side, respectively;

$q_i$ is the measurement value of the ith split backup roll load;

$\theta_i$ is an angle between each split backup roll load operation line direction and the horizontal line (entry side split backup roll has an acute angle and exit side split backup roll has an obtuse angle);

$Z_i$ is the barrel length center position of each split backup roll expressed by roll axial direction coordinates with a mill center being an origin;

$a_w$ is a center distance between an operator side chock and a driving side chock;

$F^W$ and $F^D$ are the actual values of the horizontal direction roll bending force acting on the work rolls on both operator and driving sides, wherein $F^W$ and $F^D$ may be omitted when the horizontal roll bending force is not provided.

2. A rolling apparatus for a flat-rolled metal material comprising:

a rolling mill having a construction in which either one, or both, of the upper and the lower roll assemblies have a mechanism for supporting a work roll (3, 4), by split backup rolls (5, 6) split into at least three segments in an axial direction, said split backup roll group having a construction for supporting both a vertical direction load and a rolling direction load acting on said contacting work roll, each of said split backup rolls independently having a load measuring device (9, 10);

a pair of pinch rolls (11, 12) arranged on the exit side of said rolling mill, for clamping said rolled material;

a calculating device (17) for calculating a difference $F_r^{df}$ between rolling direction force acting on said work rolls at a right side (operator side) of said work rolls and rolling direction force acting on said work rolls at a left side (driving side) of said work rolls through the rolled material using imaginary rolling direction force $F_R^W$ and $F_R^D$ acting between the rolled material and the work roll evaluated at the work roll chock position on the operator side and the driving side based on measured values of backup rolls by each independent load measuring device and the formula below;

$$F_R^W - F_R^D = (2/a_w)\Sigma Z_i q_i \cos\theta_i - (F^W - F^D)$$

a calculating device (18) for calculating a control quantity based on said calculated difference $Fr^{df}$ of rolling direction force for determining left-right difference of roll gap between said upper work roll and lower work roll to result in said difference $Fr^{df}$ of rolling direction force approaching zero;

a control device for controlling said roll gap between said upper and lower work roll based on said control quantity to set left-right difference in said roll gap between said upper work roll and lower work roll to result in said calculated difference $Fr^{df}$ of rolling direction force approaching zero;

where, $F_R{}^W$ and $F_R{}^D$ are imaginary rolling direction force when the rolling direction forces acting between the rolled material and the work roll are evaluated at the work roll chock positions on the operator side and the driving side, respectively;

$q_i$ is the measurement value of the ith split backup roll load;

$\theta_i$ is an angle between each split backup roll load operation line direction and the horizontal line (entry side split backup roll has an acute angle and exit side split backup roll has an obtuse angle);

$Z_i$ is the barrel length center position of each split backup roll expressed by roll axial direction coordinates with a mill center being an origin;

$a_w$ is a center distance between an operator side chock and a driving side chock;

$F^W$ and $F^D$ are the actual values of the horizontal direction roll bending force acting on the work rolls on both operator and driving sides, wherein $F^W$ and $F^D$ may be omitted when the horizontal roll bending force is not provided.

* * * * *